US005924557A

United States Patent [19]

Pollock

[11] Patent Number: 5,924,557

[45] Date of Patent: Jul. 20, 1999

[54] ELECTRICAL SWITCH WITH CONTACT SPRING

[75] Inventor: Scott J. Pollock, Ypsilanti, Mich.

[73] Assignee: TRW Inc., Lyndhurst, Ohio

[21] Appl. No.: 09/007,272

[22] Filed: Jan. 14, 1998

[51] Int. Cl.[6] ..... H01H 13/52

[52] U.S. Cl. ..... 200/534; 200/241; 200/243; 200/292

[58] Field of Search ..... 200/534, 535, 200/530, 532, 241, 243, 245, 250, 290, 292, 341

[56] References Cited

U.S. PATENT DOCUMENTS

| | | | |
|---|---|---|---|
| 1,699,645 | 1/1929 | Williams et al. | 200/532 |
| 4,496,803 | 1/1985 | Smith | 200/532 |
| 4,789,764 | 12/1988 | Doros . | |
| 5,061,094 | 10/1991 | Buttner et al. . | |

*Primary Examiner*—Renee S. Luebke
*Attorney, Agent, or Firm*—Tarolli, Sundheim, Covell, Tummino & Szabo

[57] ABSTRACT

A switch (10) includes a pair of fixed contacts (20,22) spaced apart from each other. The switch (10) also includes a contact member (40) including a resilient base (42) and a pair of contact arms (80,82) connected to and extending from the base in a direction toward the fixed contacts (20,22). The switch (10) also includes a manually engageable member (110) connected with the contact member (40) for, upon the application of a predetermined force to the manually engageable member, moving the contact arms (80,82) into electrical contact with the fixed contacts (20,22) to complete an electric circuit between the fixed contacts. The resilient base (42) of the contact member (40) yields upon the application of the predetermined force to the manually engageable member (110). The resilient base (42) moves the contact arms (50,52) out of electrical contact with the fixed contacts (20,22) upon removal of the predetermined force from the manually engageable member (110).

12 Claims, 2 Drawing Sheets

ELECTRICAL SWITCH WITH CONTACT SPRING

BACKGROUND OF THE INVENTION

1. Technical Field

The present invention relates to an electrical switch. In particular, the present invention relates to an electrical switch including a return spring which is formed as one piece with one of the electrical contacts of the switch.

2. Description of the Prior Art

Electrical switches are used for controlling electrically actuatable devices, for example, power windows of a vehicle. It is desirable to minimize the complexity and number of parts of a switch assembly. U.S. Pat. Nos. 5,061,094 and 4,789,764 disclose electrical switches including a return spring which is formed as one piece with one of the electrical contacts of the switch.

SUMMARY OF THE INVENTION

The present invention is a switch comprising a pair of fixed contacts spaced apart from each other. The switch also comprises a contact member including a resilient base and a pair of contact arms connected to and extending from the base in a direction toward the fixed contacts. The switch further comprises a manually engageable member connected with the contact member for, upon the application of a predetermined force to the manually engageable member, moving the contact arms into electrical contact with the fixed contacts to complete an electric circuit between the fixed contacts. The resilient base of the contact member yields upon the application of the predetermined force to the manually engageable member. The resilient base moves the contact arms out of electrical contact with the fixed contacts upon removal of the predetermined force from the manually engageable member.

BRIEF DESCRIPTION OF THE DRAWINGS

Further features of the present invention will become apparent to those skilled in the art to which the present invention relates from reading the following specification with reference to the accompanying drawings, in which.

DESCRIPTION OF A PREFERRED EMBODIMENT

Figure 1:
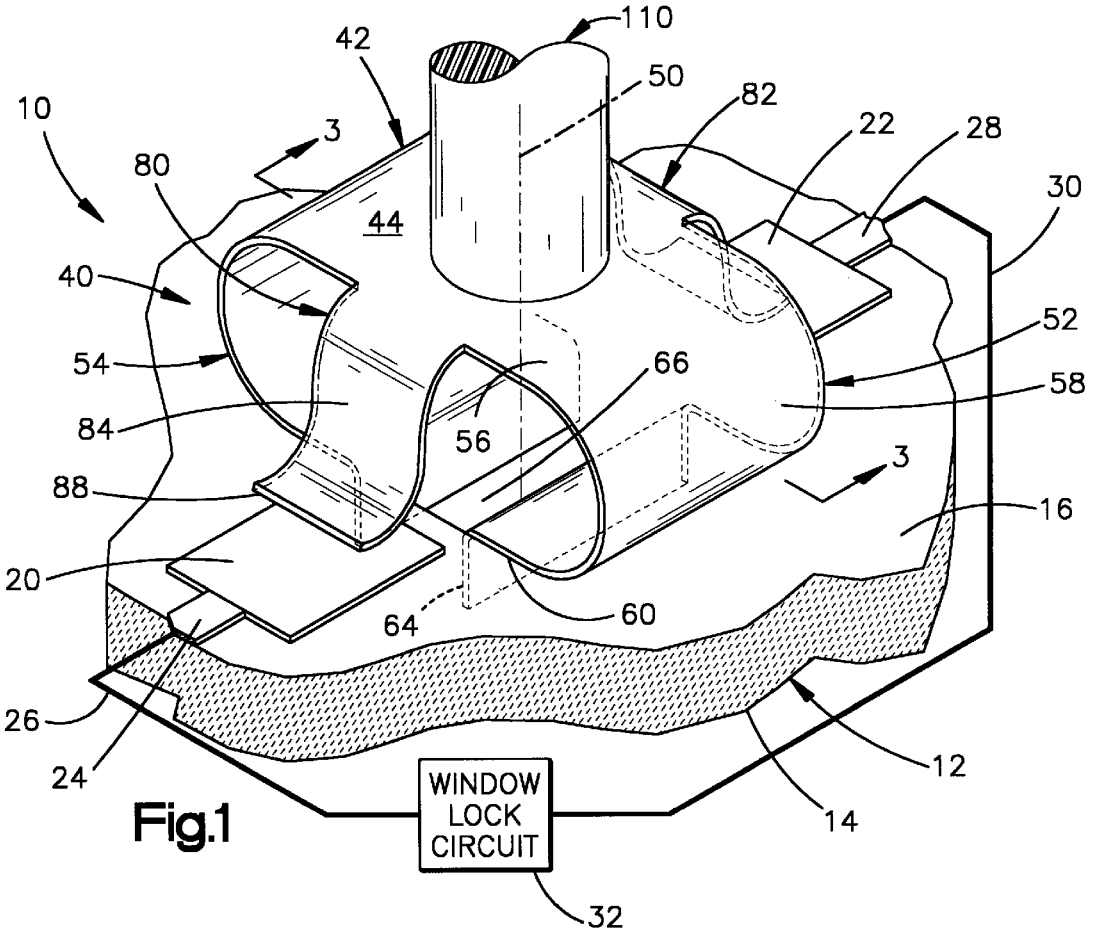
FIG. 1 is a schematic illustration of an electrical switch constructed in accordance with the present invention, including a contact spring.

The present invention relates to an electrical switch. In particular, the present invention relates to an electrical switch including a return spring which is formed as one piece with one of the electrical contacts of the switch. As representative of the present invention, FIG. 1 illustrates schematically an electrical switch 10.

The switch 10 is mounted on a portion of a printed circuit board or PC board 12 having a generally planar configuration. The PC board 12 includes an electrically insulating substrate 14. The substrate 14 has a planar upper (as viewed in FIG. 1) side surface 16.

A pair of fixed contacts 20 and 22 are disposed on the upper side surface 16 of the substrate 14. The first fixed contact 20 is connected by a conductive trace 24 to a lead wire indicated schematically at 26. The second fixed contact 22 is connected by a conductive trace 28 to another lead wire indicated schematically at 30.

The lead wires 26 and 30 are connected with vehicle electric circuitry indicated schematically at 32. In the illustrated embodiment, the vehicle electric circuitry 32 is a window lock circuit which is actuatable to prevent operation of the vehicle power windows (not shown).

The switch 10 includes a movable contact or contact member for completing an electric circuit between the fixed contacts 20 and 22. In the illustrated embodiment, the contact member is a contact spring 40. The contact spring 40 is formed as one piece from an electrically conductive material, preferably beryllium copper about 0.15 millimeters thick. The contact spring 40 also serves as a return spring for the switch 10, as described below.

Figure 2:
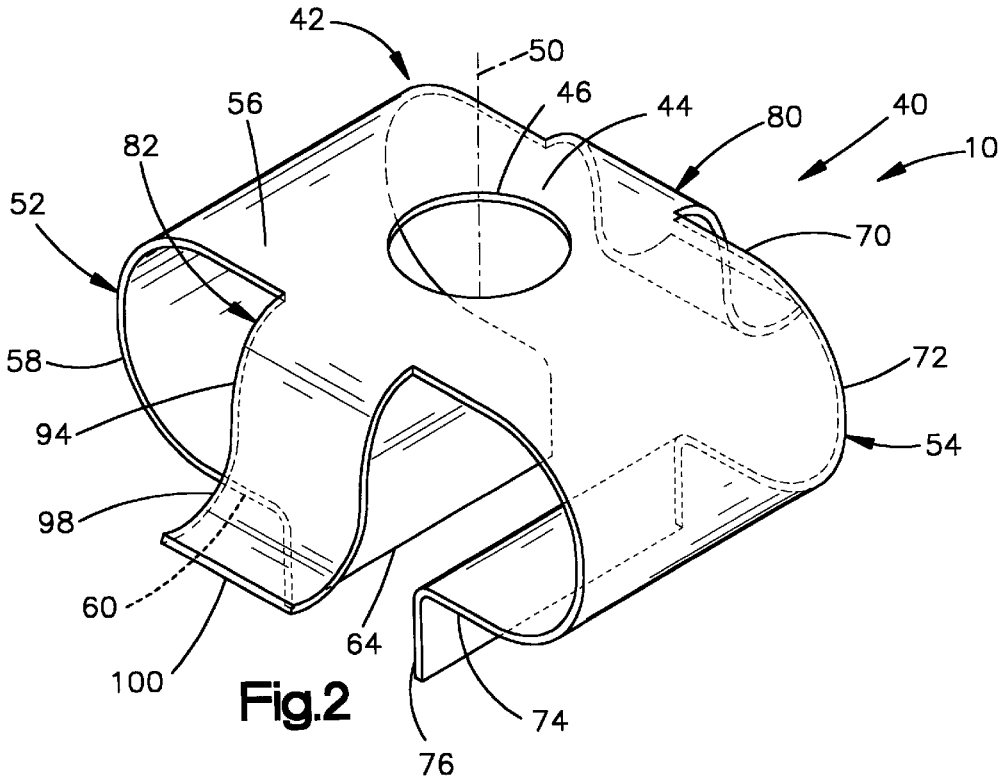
FIG. 2 is a perspective view of the contact spring of FIG. 1, shown in an orientation rotated 180 degrees from that shown in FIG. 1.

The contact spring 40 includes a resilient base 42. The base 42 has a flattened O-shaped configuration as viewed from the side, for example, in FIG. 3. The base 42 includes a planar central portion 44 which has a generally rectangular configuration. The central portion 44 lies in a plane generally parallel to the plane of the fixed contacts 20 and 22. A circular opening 46 (FIG. 2) extends through the central portion 44 of the base 42 and is centered on an axis 50 of the switch 10. The axis 50 extends normal to the plane of the PC board 12.

The resilient base 42 of the contact spring 40 also includes two support arms or leaf springs 52 and 54 which extend from opposite sides of the central portion 44 of the base. The first leaf spring 52 (FIG. 1) is a resilient strip of metal including a first portion 56 which extends from the central portion 44 of the base 42 in a direction away from the axis 50, in the plane of the central portion. A second portion 58 of the first leaf spring 52 extends from the first portion, in a 180° arc away from the axis 50, toward the PC board 12, and back toward the axis. A third portion 60 of the first leaf spring 52 extends from the second portion 58 in a direction parallel to the plane of the PC board 12.

The first leaf spring 52 terminates in a tab 64. The tab 64 extends from the third portion 60 of the first leaf spring 52, in a direction parallel to the axis 50 and away from the central portion 44 of the base 42.

The tab 64 is received in a slot 66 (FIGS. 1 and 3) in the PC board 12. The slot 66 is disposed between the fixed contacts 20 and 22 and is centered on the axis 50. When the first leaf spring 52 is in the free condition shown in FIGS. 2–4, the tab 64 extends generally perpendicular to the plane of the PC board 12. The third portion 60 of the first leaf spring 52 overlies the upper side surface 16 of the substrate 14 of the PC board 12.

The second leaf spring 54 is a mirror image of the first leaf spring 52. The second leaf spring 54 (FIG. 2) is a resilient strip of metal including a first portion 70 which extends from the central portion 44 of the base 42 in a direction away from the axis 50, in the plane of the central portion. A second portion 72 of the second leaf spring 54 extends from the first portion 70, in a 180° arc away from the axis 50, toward the PC board 12, and back toward the axis. A third portion 74 of the second leaf spring 54 extends from the second portion 72 in a direction parallel to the plane of the PC board 12.

The second leaf spring 54 terminates in a tab 76. The tab 76 extends from the third portion 74 of the second leaf spring 54, in a direction parallel to the axis 50 and away from the central portion 44 of the base 42. The tab 76 is received in the slot 66 in the PC board 12. When the second leaf spring 54 is in the free condition shown in FIGS. 2–4, the tab 76 extends generally perpendicular to the plane of the PC board 12. The third portion 74 of the second leaf spring 54 overlies the upper side surface 16 of the substrate 14 of the PC board 12. The slot 66 is wide enough so that the tabs 64 and 76 of the contact spring 40 do not engage each other when the switch 10 is in the unactuated condition shown in FIG. 3.

The contact spring 40 includes first and second contact arms 80 and 82 which extend from opposite sides of the base 42 in a direction toward the first and second fixed contacts 20 and 22, respectively. The contact arms 80 and 82 are located between the support arms 52 and 54 to form a generally X-shaped configuration.

The first contact arm 80 (FIGS. 1 and 4) is a resilient strip of metal having a first portion 84 which extends from the central portion 44 of the base 42. The first portion 84 of the first contact arm 80 has a downwardly concave (as viewed in FIGS. 1–6) configuration and extends from the central portion 44 in a direction toward the PC board 12. A second portion or end portion 88 of the first contact arm 80 has an upwardly concave (as viewed in FIGS. 1–6) configuration and extends from the first portion 84 in a direction toward the first fixed contact 20. The end portion 88 of the first contact arm 80 has a contact surface 90 which is presented toward the first fixed contact 20. The contact surface 90 on the first contact arm 80 is spaced above the first fixed contact 20 when the switch 10 is in the unactuated condition shown in FIGS. 1–4.

The second contact arm 82 (FIGS. 2 and 4) is a mirror image of the first contact arm 80. Specifically, the second contact arm 82 is a resilient strip of metal including a first portion 94 which extends from the central portion 44 of the base 42. The first portion 94 of the second contact arm 82 has a downwardly concave (as viewed in FIGS. 1–6) configuration and extends from the central portion 44 in a direction toward the PC board 12.

A second portion or end portion 98 of the second contact arm 82 has an upwardly concave (as viewed in FIGS. 1–6) configuration and extends from the first portion 96 in a direction toward the second fixed contact 22. The end portion 98 of the second contact arm 82 has a contact surface 100 which is presented toward the second fixed contact 22. The contact surface 100 on the second contact arm 82 is at the same distance above the PC board 12 as the contact surface 90 on the first contact arm 80, when the switch 10 is in the unactuated condition shown in FIGS. 1–4.

A manually engageable member shown partially at 110 is connected with the contact spring 40 for, upon the application of a predetermined force to the manually engageable member, moving the contact arms 80 and 82 into electrical contact with the fixed contacts 20 and 22 to complete an electric circuit between the fixed contacts. In the illustrated embodiment, the manually engageable member 110 is a generally cylindrical post. The post 110 (FIG. 3) is formed from an electrically insulating material, preferably plastic. The post 110 has an annular shoulder surface 112 which extends radially between a smaller diameter first section 114 of the post and a larger diameter second section 116 of the post.

When the switch 10 is assembled, the first section 114 of the post 110 extends through the central opening 46 in the base 42 of the contact spring 40. The shoulder surface 112 on the post 110 is in abutting engagement with the central portion 44 of the base 42 of the contact spring 40. The second section 116 of the post 110 extends away from the contact spring 40 and terminates in a push button (not shown) or other manually engageable member.

Figure 3:
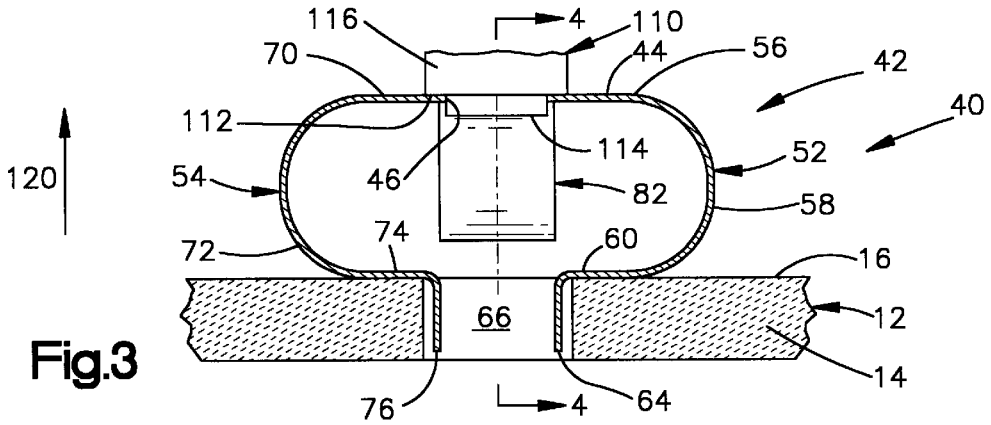
FIG. 3 is a sectional view taken generally along line 3—3 of FIG. 1, showing the switch of FIG. 1 in an unactuated condition.
Figure 4:
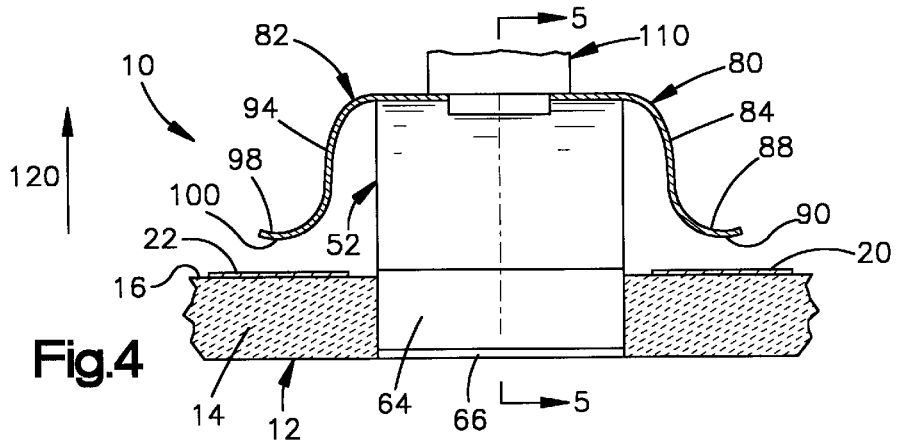
FIG. 4 is a sectional view taken generally along line 4—4 of FIG. 3.

The resilience of the base 42 biases the central portion 44 of the base in a direction away from the PC board 12, as indicated by the arrow 120 in FIGS. 3 and 4. The engagement of the central portion 44 of the base 42 with the shoulder surface 112 of the post 110 biases the post in the same direction 120. A suitable mechanism (not shown) is provided for limiting movement of the post 110 and the central portion 44 of the base 42 in the direction 120.

Upon the application to the post 110 of a predetermined force in an opposite direction 122 (FIGS. 5 and 6), the resilient base 42 yields. Specifically, the leaf springs 50 and 52 resiliently deflect from the condition shown in FIG. 3 to the condition shown in FIG. 5. The central portion 44 of the base 42 moves toward the PC board 12, in the direction indicated by the arrow 122.

Figure 6:
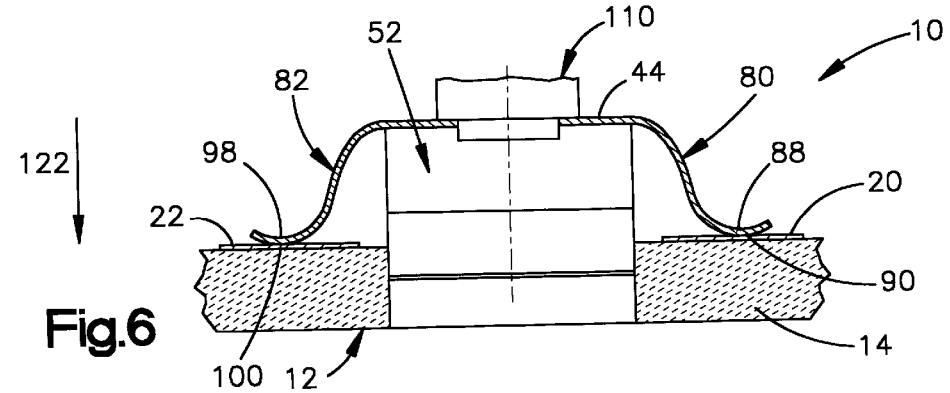
FIG. 6 is a view similar to FIG. 4 showing the switch in an actuated condition.

The movement of the central portion 44 of the base 42 toward the PC board 12 causes the contact arms 80 and 82 to deflect from the condition shown in FIG. 4 to the condition shown in FIG. 6. The contact arms 80 and 82 move toward and into engagement with the PC board. The contact surfaces 90 and 100 on the contact arms 80 and 82 move into electrical contact with the fixed contacts 20 and 22, respectively, on the PC board 12. The engagement between the contact arms 80 and 82 and the fixed contacts 20 and 22 completes an electric circuit through the contact spring 40 between the fixed contacts. The contact surfaces 90 and 100 are moving laterally (away from the axis 50) when they engage the contacts 20 and 22, as well as vertically, to help keep the contacts of the switch clean.

Upon removal of the predetermined force from the post 110, the resilience of the base 42 of the contact spring 40 moves the central portion 44 of the base away from the PC board 12, in the direction 120. The movement of the base 42 in the direction 120 causes the contact arms 80 and 82 to move out of electrical contact with the fixed contacts 20 and 22. The electric circuit between the fixed contacts 20 and 22 is broken. The switch 10 returns to its unactuated condition.

Figure 5:
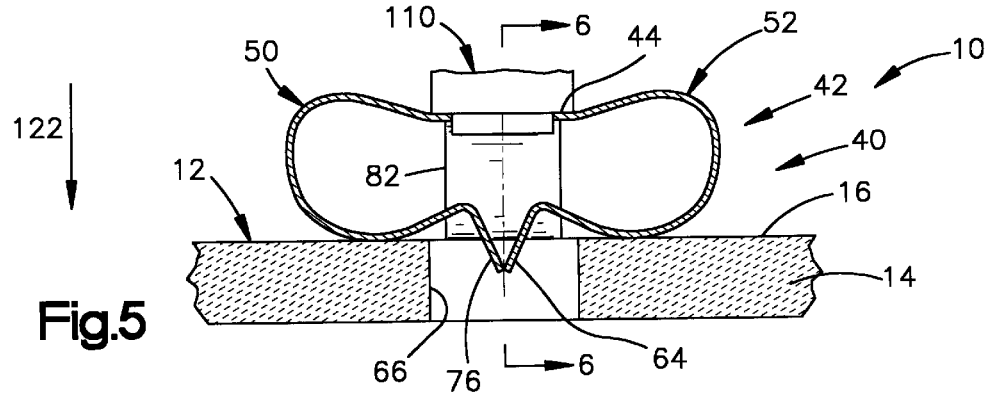
FIG. 5 is a view similar to FIG. 3 showing the switch in an actuated condition.

The switch 10 is preferably used in a push-push type of application. In this type of application, the switch 10 is normally in an unactuated condition as shown in FIGS. 3 and 4. Upon the application of the predetermined force to the post 110, the switch 10 moves to an engaged condition as shown in FIGS. 5 and 6. The axial movement involved may be about three millimeters, for example. A locking mechanism (not shown) connected with the post maintains the switch 10 in the engaged condition. A completed electric circuit is maintained between the fixed contacts 20 and 22. Upon the application of additional force to the post 110 in the direction 122, the post 110 moves a small distance (for example, one millimeter) closer to the PC board 12, causing the locking mechanism to release. The resilience of the contact spring 40 then returns the switch 10 to the unactuated condition.

From the above description of the invention, those skilled in the art will perceive improvements, changes and modifications in the invention. Such improvements, changes and modifications within the skill of the art are intended to be covered by the appended claims.

Having described the invention, I claim:

1. A switch comprising:

a printed circuit board having an opening;

a pair of fixed contacts disposed on said printed circuit board;

a contact member comprising a resilient base received in said opening, said resilient base supporting a pair of contact arms connected to and extending from said base to a location disposed above said fixed contacts; and a manually engageable member connected to said contact member;

said resilient base yielding upon the application of a predetermined force to said manually engageable member, said contact arms moving into electrical contact with said fixed contacts to complete an electric circuit between said fixed contacts;

said resilient base moving said contact arms out of electrical contact with said fixed contacts upon removal of said predetermined force from said manually engageable member.

2. A switch as set forth in claim 1 wherein said contact member is made from a single piece of electrically conductive metal.

3. A switch as set forth in claim 2 wherein said resilient base has a generally O-shaped configuration which compresses when it yields.

4. A switch as set forth in claims 3 wherein said resilient base includes first and second leaf springs each having a generally arcuate configuration, said first and second leaf springs extending from a central portion of said base in opposite directions from each other, said contact arms being disposed intermediate said leaf springs and extending from said central portion of said base in opposite directions from each other.

5. A switch as set forth in claim 1 wherein said base includes a central opening which receives said manually engageable member.

6. A switch as set forth in claim 1 wherein said fixed contacts lie in a first plane, said base has a central portion which lies in a second plane parallel to and spaced apart from said first plane, said central portion of said base moving toward said first plane upon the application of the predetermined force to said manually engageable member.

7. A switch as set forth in claim 6 wherein said base comprises a pair of support arms, said support arms and said contact arms forming a generally X-shaped configuration.

8. An apparatus comprising:

a printed circuit board having an opening;

a pair of fixed contacts disposed on said printed circuit board on opposite sides of said opening;

a manually engageable member; and a contact member disposed on said printed circuit board, said contact member connected to said manually engageable member at a location spaced apart from said printed circuit board;

said contact member comprising a piece of resilient spring metal having a central portion and having four arms extending outward from said central portion, said central portion being connected to said manually engageable member for movement with said manually engageable member;

said four arms including first and second diametrically opposite support arms and first and second diametrically opposite contact arms;

said first and second support arms having a curved configuration extending from said central portion and having respective end portions received in said opening and supporting said contact arms of said contact member at a location disposed above said fixed contacts on said printed circuit board;

said first and second contact arms having a curved configuration extending from said central portion and having respective end portions spaced apart from said fixed contacts;

said contact arms having end portions which engage said fixed contacts, said end portions moving into engagement with said fixed contacts upon movement of said central portion of said contact member to a first position and said end portions moving laterally along said fixed contacts upon movement of said central portion of said contact member from the first position to a second position;

said curved support arms resiliently compressing and said contact arms moving into electrical contact with said fixed contacts to complete an electric circuit between said fixed contacts upon the application of force to said manually engageable member.

9. An apparatus as set forth in claim 8 wherein said contact member is made from a single piece of electrically conductive metal and has a generally O-shaped configuration which compresses when it yields.

10. An apparatus as set forth in claim 8 wherein said central portion of said contact member includes a central opening which receives said manually engageable member.

11. An apparatus as set forth in claim 8 wherein said support arms comprise first and second leaf springs extending from said central portion of said contact member in opposite directions from each other, said contact arms being disposed intermediate said leaf springs and extending from said central portion of said contact member in opposite directions from each other.

12. An apparatus as set forth in claim 11 wherein said support arms and said contact arms form a generally X-shaped configuration.

* * * * *